US005271164A

United States Patent [19]

Yoshimura et al.

[11] Patent Number: 5,271,164

[45] Date of Patent: Dec. 21, 1993

[54] METHOD AND APPARATUS FOR DRYING CONTAINERS

[75] Inventors: Takayuki Yoshimura, Omiya; Yoshiteru Kondoh, Tokyo; Yoshimasa Matsumura, Sagamihara; Kiyoaki Inoue, Hachiouji, all of Japan

[73] Assignee: Daiwa Can Company, Tokyo, Japan

[21] Appl. No.: 943,500

[22] Filed: Sep. 11, 1992

[30] Foreign Application Priority Data

Sep. 11, 1991 [JP] Japan ..... 3-259640
Sep. 11, 1991 [JP] Japan ..... 3-259641
Jan. 27, 1992 [JP] Japan ..... 4-035562

[51] Int. Cl.[5] ..... F26B 25/00

[52] U.S. Cl. ..... 34/105; 34/106; 34/21; 198/400; 15/304; 15/309.2

[58] Field of Search ..... 34/104, 105, 106, 107, 34/21, 201, 69; 198/400; 15/303, 304, 309.2

[56] References Cited

U.S. PATENT DOCUMENTS 1,689,757 10/1928 Taylor ..... 15/309.2
2,073,746 3/1937 Keller ..... 15/304
2,255,615 9/1941 Frankel ..... 15/304
2,523,080 9/1950 Webb ..... 34/105
2,660,513 11/1953 Ball ..... 15/304
2,917,768 12/1959 Walberer ..... 15/304
3,568,238 4/1969 Fischer ..... 15/309.2
3,574,952 4/1971 Lee, Jr. ..... 34/105
3,952,698 4/1976 Beyer et al. ..... 118/314
3,983,597 10/1976 Neumann ..... 15/304
4,053,993 10/1977 Schregenberger ..... 34/105
4,208,761 6/1980 Ionescu ..... 15/304
4,492,571 1/1985 Miura ..... 34/105
4,665,624 5/1987 Wodis ..... 33/507
4,665,626 5/1987 Berkman et al. ..... 34/1
5,012,547 5/1991 Marsh ..... 15/304

FOREIGN PATENT DOCUMENTS 0253025 1/1988 European Pat. Off. .
4733348 11/1972 Japan .
50-77440 6/1975 Japan .
1163082 9/1969 United Kingdom .

*Primary Examiner*—Henry A. Bennet
*Assistant Examiner*—Denise L. Gromada
*Attorney, Agent, or Firm*—Oblon, Spivak, McClelland, Maier & Neustadt

[57] ABSTRACT

A drying arrangement includes transport device which uses suction or magnetism to produce an attractive force via which containers can be picked up by their bottom wall after they have come out of a washing station, and carried with an open end thereof oriented downwardly, over a nozzle arrangement which suctions off water in liquid form from the containers and over an arrangement which uses hot air to dry off the remaining water.

19 Claims, 5 Drawing Sheets

METHOD AND APPARATUS FOR DRYING CONTAINERS

BACKGROUND OF THE INVENTION

1. Field of the Invention

The present invention relates to a method and device for drying a container of the type such as a two piece can body which has an integrally formed bottom and peripheral wall, after it has been washed.

2. Description of the Prior Art

In recent years two piece beverage cans have come into wide use. The can body of these containers is usually made of tin plated or aluminium alloy sheet and formed by pressing such as drawing and ironing or deepdrawing. This is followed by trimming of the edge defined about the open end.

In order to remove lubricant used in the deep drawing or ironing steps, so as to ensure good adhesion of paint and the like, the can body is subjected to degreasing, water rinsing, chemical treatment, de-ionized water rinsing and then dried. Further, the internal and external surfaces of the can body are covered with organic coating films.

U.S. Pat. No. 3,574,952 issued on Apr. 13th, 1971 in the name of Lee, Jr. (corresponding Japanese first provisional publication JP-A-47-33348) discloses a device for drying can bodies and the like type of containers after they have been washed using water or de-ionized water.

In brief, the above mentioned drying device uses a chain conveyor and a hot drying chamber through which hot air is circulated. After the containers are washed they are placed on top of the chain conveyor with the open ends oriented downwardly and moved into the drying chamber. Jets of air which is heated to a predetermined temperature, are directed down onto the external surfaces of the containers through a flow diffusing member. A perforate plate is arranged below the chain conveyor on which the containers are supported and arranged to create a reduced pressure and to produce a venturi effect which induces some of the heated air to circulate up into the containers.

U.S. Pat. No. 3,952,698 issued on Apr. 27, 1976 in the name of Beyer et al. (corresponding Japanese first provisional publication JP-A-50-77440) discloses an arrangement wherein can bodies of the two piece can type are placed in an inverted condition (viz., with the open end oriented downwardly) on an open net or meshwork conveyor. Air is induced to flow down from an overhead source over the external surface of the containers. This procedure is such as to blow off excess water from the external surfaces of the containers and leave the same coated with a small amount of residual moisture. The reason for not completely drying the surfaces is that, by having a thin water film or moisture layer on the order of a few hundredths of mils thick, the adhesive affinity of the metal surfaces to a subsequent water based coating is alleged to be improved measurably depending on the material used.

However, these arrangements have suffered from one or more drawbacks. That is to say, in the arrangement disclosed in U.S. Pat. No. 3,574,952, the heated air is induced to flow downwardly onto the containers which are placed in an inverted position on the chain conveyor. This downward flow presses the containers down onto the conveyor and obviates the need for special apparatus to hold the same in place. Further, some of the heated air circulates up into the interior of the container and thus the interior of the container can be dried along with the external surface. However, some water droplets tend to remain within the containers and lead to the situation wherein they cause contaminates to be undesirably transferred from the chain conveyor which is in direct contact with the edge of the containers, into the interior of the containers. In addition to this problem, while the flow of air produced by the hot air jets blows off the water droplets on the external surfaces of the containers, the air flow within the containers is slower and insufficient to assuredly remove the water on the inner surfaces. Accordingly, in order for complete drying to be achieved, the containers must be exposed to the hot air sufficiently long for the residual water within the containers to be removed via evaporation. This of course tends to increase the drying time and slows the drying process.

Further, in connection with the arrangement disclosed in U.S. Pat. No. 3,952,698, even though air is directed into the interior of the containers, such an arrangement cannot be applied in situations wherein complete drying is demanded, as the process is not directed toward achieving complete drying.

SUMMARY OF THE INVENTION

The main object of the present invention is to provide a drying apparatus for containers having an open end, which can receive the containers as they come out of a washing station and which can transport the containers without the open end thereof coming into contact with any of the apparatus involved.

It is another object of the present invention to provide a drying apparatus which can receive containers from a washing station and remove a first portion of the water therefrom in liquid form and thereafter remove the remaining portion via evaporation.

It is further object of the present invention to provide a drying apparatus for the above mentioned type of containers which reduces both the amount of heat energy and time required to achieve the drying of the same.

Another object of the invention is to provide a drying apparatus which allows the overall length of the same to be reduced.

Still another object of the present invention is to prevent contamination of the interior of the container while it is within the drying apparatus.

In brief, a first major aspect of the present invention comes in a drying apparatus which features a transport arrangement via which washed containers can be received in an inverted state (viz., with the open ends thereof oriented downwardly), secured by their bottom wall and transported to a first stage wherein the edges of the open ends face suction nozzles and then to a second stage wherein blow nozzles are disposed.

A second aspect of the invention comes in that the transport arrangement makes use of either suction or magnetism to produce an attractive force which is applied to the bottom wall of the container and which allows the container to be picked up and transported in an inverted state through the drying apparatus.

A further aspect of the invention comes in that the drying apparatus is arranged so that drying air, which is heated in a heater and directed against the containers to dry the same, is inducted by a suction arrangement which is used to support the containers in their inverted positions, and recycled to the heater.

Another aspect of the invention comes in that the air which is used to dry the container is directed against either the internal or external surfaces of the containers.

Yet another aspect of the invention comes in that air injection nozzles are used to direct jets of air into the interior of the containers in a manner which scavenges and/or drives residual water on the internal surfaces of the containers toward the open ends thereof.

The above and further objects and novel features of the invention will become more fully appreciated from the following detailed description when taken in connection with the accompanying drawings.

It is to be expressly understood, however, that the drawings are for the purpose of illustration only and are not intended as a definition of the limits of the present invention.

DETAILED DESCRIPTION OF THE PREFERRED EMBODIMENT

A detailed description of an embodiment of the invention will now be given with reference to the drawings.

Figure 1:
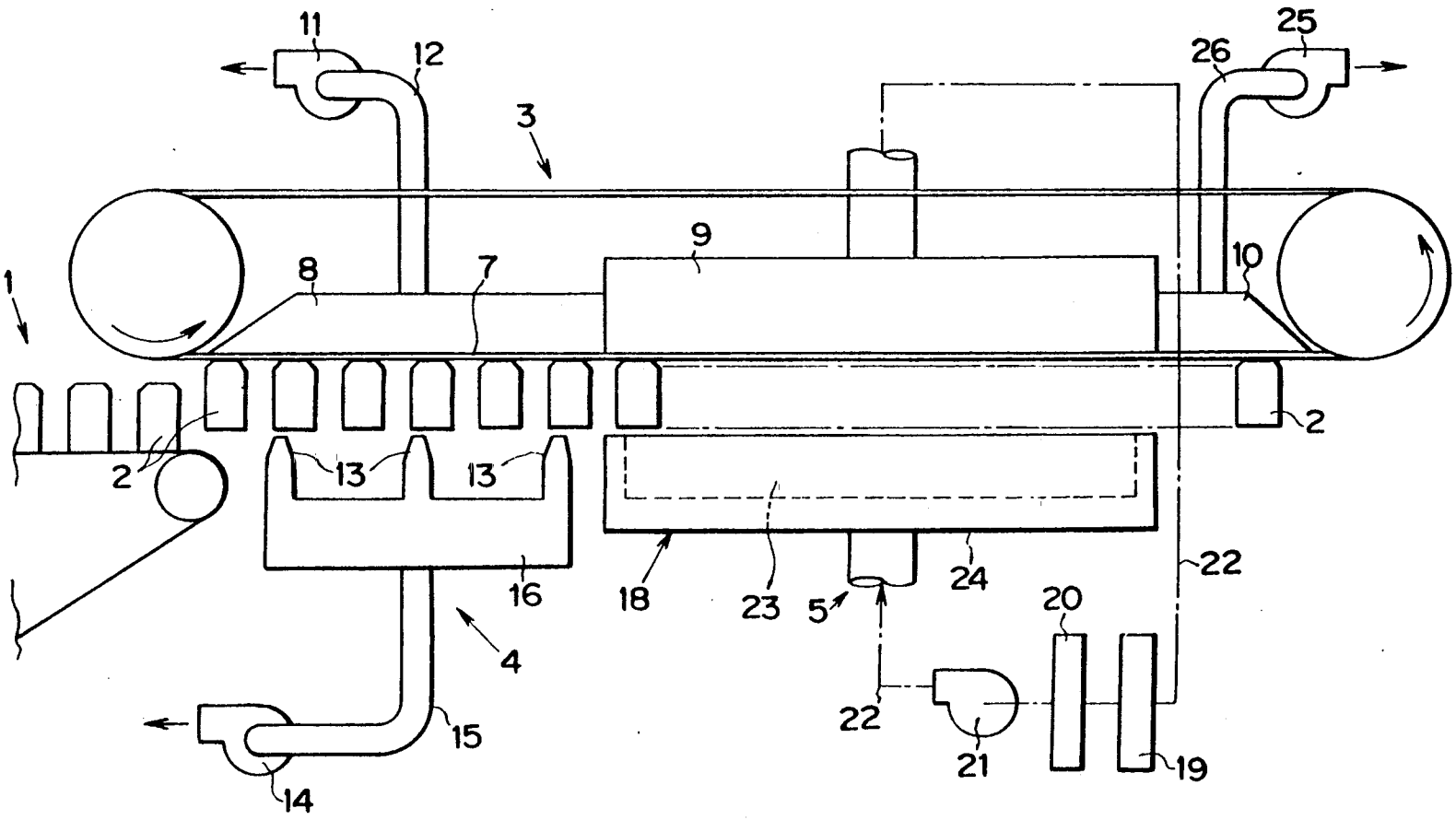
FIG. 1 shows a drying apparatus in which the various nozzle arrangements, which characterize a first embodiment of the present invention, are deployed therein.

FIG. 1 shows a drying station into which containers 2, which are still wet with rinse water, are transferred from a washing station 1. The drying station includes a conveyor device 3 which picks up the containers 2 in an inverted state and carries the same over a water removal stage 4 wherein residual water is sucked or vacuumed off, and then over a blow off stage wherein a flow of hot air is directed thereagainst. The containers 2 in this instance are of the type shown in FIG. 2 which are produced by drawing and ironing and which have a bottom wall, an integral side wall and an open end. As illustrated in FIG. 1, the containers 2 come out of the washing stage 1 in an inverted state, that is with the bottom wall up and so the open end is oriented downwardly.

Figure 4:
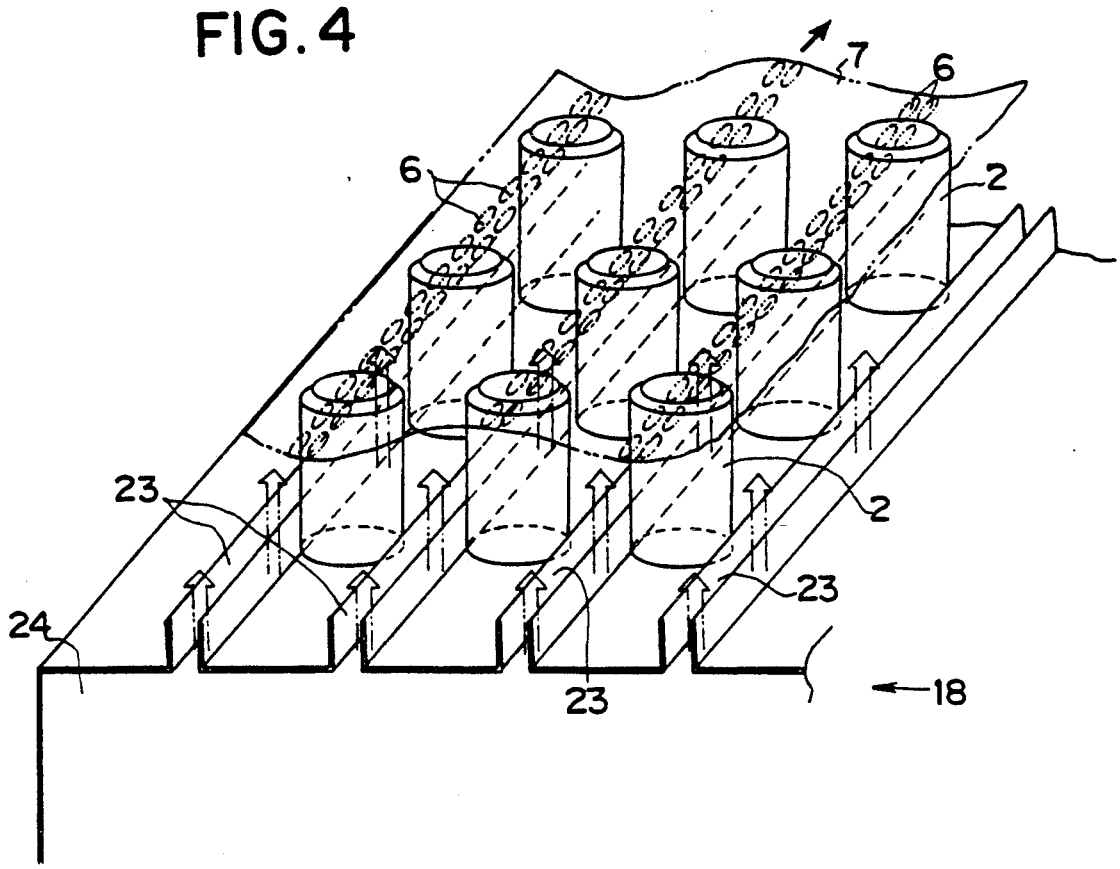
FIG. 4 is a perspective view showing an external surface drying nozzle arrangement via which a flow of drying air is directed against the external surfaces of the containers.
Figure 6:
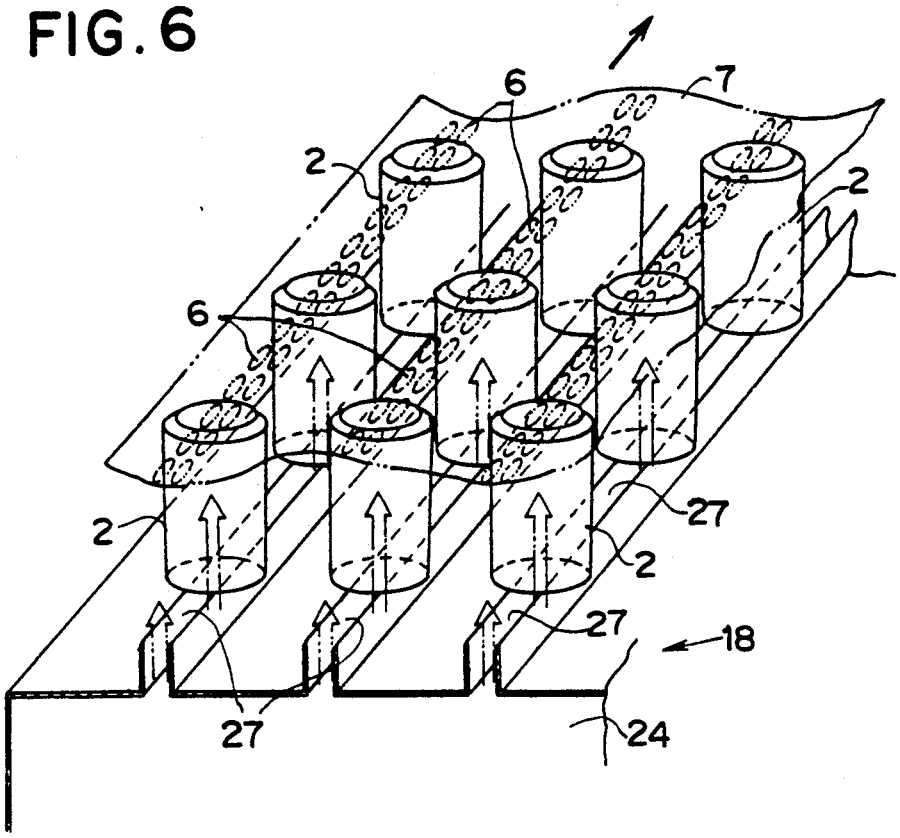
FIG. 6 is a perspective view showing an internal surface drying nozzle arrangement via which a flow of drying air is directed into and against the internal surfaces of the containers in accordance with a second embodiment of the present invention.

The conveyor 3 in this case, includes an endless perforate conveyor belt 7 through which rows of elongate suction holes 6 are formed (see FIGS. 4 and 6). The direction of elongation of the holes is parallel to the direction in which the belt moves. A suction arrangement includes suction heads 8, 9 and 10 which are arranged to induce air through the holes 6 and to enable the containers 2 to be sucked up against the lower surface of the belt and held there by the reduced pressure which is produced between the lower surface of the belt and the external surface of the container bottom.

The first suction head 8 is arranged over the water removal stage 4 and close proximity of the upper surface of the belt 7. The first suction head 8 is fluidly communicated with an exhaust air blower 11 by way of duct 12.

With this arrangement, rows of containers 2 which come out of the washing station are picked up and held against the lower surface of the infeed end or upstream end of the belt 7 (left hand end as seen in the drawings) by the reduced pressure which is induced by the suction head 8, and carried over the water removal stage 4.

The water removal stage 4 in this embodiment includes a number of elongate narrow slit type suction nozzles 13 which extend laterally with respect to the direction in which the belt 7 moves. The suction nozzles 13 are fluidly communicated with a water removal blower 14. The blower 14 in this instance is communicated by way of a duct 15 with a suction box 16. The nozzles 13 extend upwardly from the suction box 16 to a height which is immediately proximate the open ends of the suspended containers 2.

Figure 3:
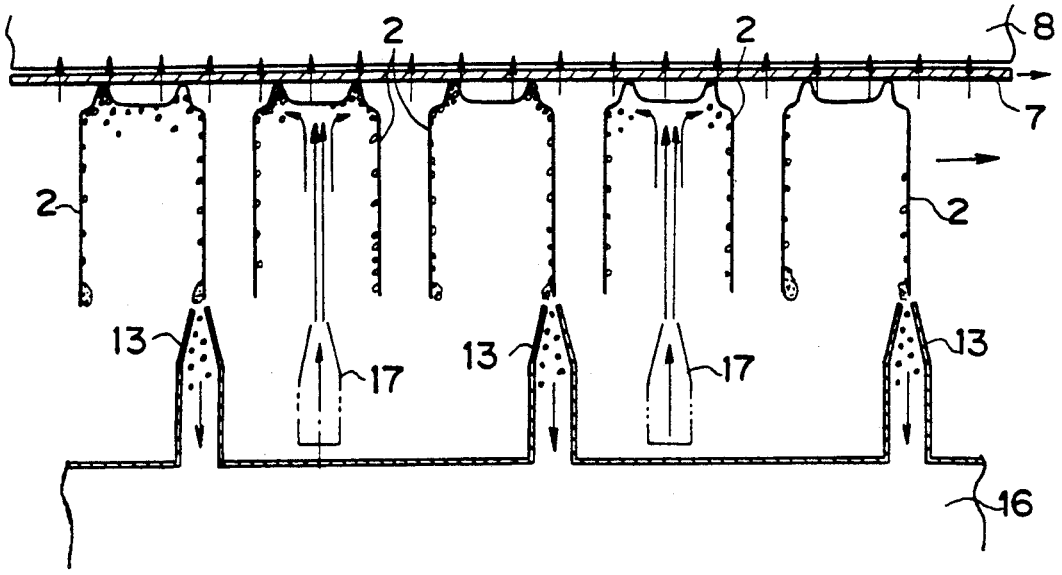
FIG. 3 is a schematic sectional view showing a suction nozzle arrangement which forms part of a water removal stage of the first embodiment.

In this embodiment the suction nozzles 13 are spaced at predetermined intervals in the direction in which the containers are carried, in the manner generally depicted in FIG. 3.

It should be noted that circular cross-section type blow nozzles 17 (shown in phantom in FIG. 3) are arranged to direct jets of air upwardly into the containers and are arranged in rows at discrete intervals between the suction nozzles 13.

Figure 2:
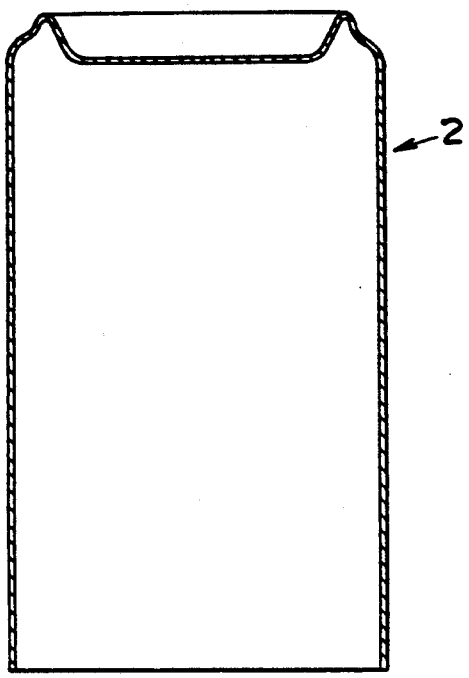
FIG. 2 is a sectional view showing an example of the container (a two piece can body) and the inverted state in which it is transferred through the drying apparatus according to the present invention.

The reason for the provision of the blow nozzles 17 is that, as shown in FIG. 2, the bottom wall of the container is such that it includes an inwardly protruding wall portion whereby water drops tends to be retained on the internal surface thereof. The jets of air from the blow nozzles 17 are such as to enter the containers 2 and flow along the internal surfaces thereof in a manner which scavenges the drops of water off the bottom wall portions, and then push these and/or other drops, down along the container walls toward the open ends thereof.

It should be noted that in order to provide time for the water droplets to flow down to the open end of the container (viz., allow for the water droplets to arrive at the open end of the container as a result of the air injection, at the time the container passes over a suction nozzle), the blow nozzles 17 are arranged in a predetermined manner with respect to the suction nozzles 13. That is to say, as shown in the drawings, in the case that there are a plurality of suction nozzles 13, the injection nozzles are preferably disposed well upstream of the suction nozzles (with respect to the direction in which the containers move).

The suction head 9 forms part of the hot air drying section or stage of the drying apparatus, and is arranged serially with the first suction head 8 so that the containers 2 remain held against the lower surface of the conveyor belt as they pass from one stage to the next.

Located below the second suction head 9 is blow head 18. The suction head 9 and the blow head 18 are fluidly connected to form a closed circuit by way of a duct 22 in which a filter 19, a heater 20 and a blower 21 are disposed. This arrangement is such that the blower 21 is connected with a suction port of the suction head 9 by way of the filter 19 and the heater 20. This results in the situation wherein the hot filtered air discharged by the blower 21 is supplied to the blow head 18 while a reduced pressure is produced in the suction head 9.

The hot air which has passed over the containers 2 and is induced into the suction head 9 is filtered in filter 19 and then reheated in heater 20 to a predetermined temperature (e.g. 230° C). Following this, the re-heated air is induced into the blower 21 and supplied under pressure to the blow head 18.

Figure 5:
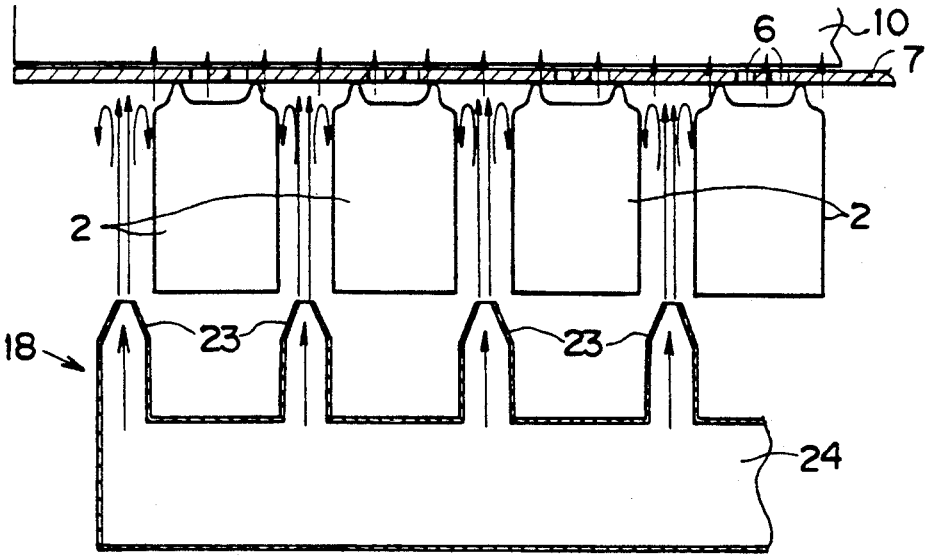
FIG. 5 is a sectional view showing the external surface drying nozzle arrangement depicted in FIG. 4.

As shown in FIG. 5, the blow head 18 is such as to inject the heated air upwardly toward the containers 2 and includes hot air nozzles 23 which extend upwardly from a chamber 24. The hot air nozzles 23 in this embodiment are of the elongate narrow slit type and are arranged to extend to a height closely proximate to the open ends of the containers 2. As will be appreciated from FIG. 4, a plurality of the hot air nozzles 23 are arranged to extend in the same direction as the containers 2 are transported and spaced with one another by a distance greater than a diameter of the containers so that the hot air, which is ejected therefrom, flows up between the rows of suspended containers and thus encounters the external surfaces of the same rather than flow into the interior thereof.

The third suction head 10 which is arranged serially with the first and second heads 8 and 9, is arranged over the next and final stage of the drying arrangement. The third suction head 10 is arranged in a similar manner to the first head 8 and, as shown in FIG. 1, is fluidly communicated with a ventilation blower 25 by wa of duct 26.

The drying system as thus far disclosed is such that the blowers 11, 14, 21 and 25 are operated along with the conveyor 3. The air which is induced through the holes 6 in the conveyor belt 7 is such that when the bottom walls of the containers 2 come into close proximity of the belt 7, a suction effect is produced and the containers 2 are picked up and held against the lower surface of the belt 7 by the resulting reduced pressure which is induced between the external surface of the containers 2 and the belt 7.

As the belt 7 moves along, the containers 2 are firstly subjected to water removal as they pass over the suction nozzles of the stage 4. At this time the residual water within the containers is induced to flow down to the open ends of the containers under the driving influence of the air which is injected thereinto from the blow nozzles 17 and then sucked off as the containers pass over the suction nozzles 13.

It should be noted that as shown in FIG. 2, the bottom wall of the containers 2 have a concave shape and that normally, any water which tends to be retained therein after the washing operation is blown off by an air injection arrangement in the washing stage itself. Therefore, there is usually not a large amount of residual water left on the exterior of the containers 2 at the time they enter the drying stage. The result of this is that the water which is sucked off by the suction nozzles 13 is predominantly from the interior of the containers 2.

Further, the previously mentioned blow nozzles 17 are such that they tend to compel the water droplets to be blown off the interior walls of the containers 2 and to migrate toward and collect at the open ends thereof. The effect of this is that, by the time the containers 2 are transported to the next drying stage, a considerable amount of the residual water has been removed and as such, the amount of heat energy which is required in the hot air drying stage is considerably reduced and the amount of time required for drying notably shortened.

As will be appreciated from above, the suction heads 8 and 9 are arranged in series such that the containers remain suspended on the lower surface of the conveyor belt 7 as they pass from the first water removal stage into the hot air blow off zone.

As the hot air which is ejected from the hot air nozzles 23 has been heated to a predetermined temperature the containers 2 are dried by the exposure of their exterior to the hot air flows.

Thus, only a small amount of water present on the surface of the containers need to be evaporated and the containers are brought to a nearly completely dried condition in a relatively short period of time. Further, as the hot air which is ejected from the hot air nozzles 23 is, for the greater part, induced by the second suction head 9, and thereafter recirculated, the amount of heat loss from the system is remarkably minimized.

Thus, in accordance with the present invention the containers can be reduced to an almost completely dry state without the open end thereof coming into contact with any part of the apparatus and therefore without the risk of contamination of the internal surfaces in either of the two stages involved. This obviates any detrimental effects on the painting of the containers in a later process.

In addition to this, as a large amount of the residual water can be removed using the suction nozzles, the time required to dry the containers using hot air can be greatly reduced as compared with the prior art. The effect of this is such that the time necessary for drying and the overall length of the drying device can both be reduced.

Figure 7:
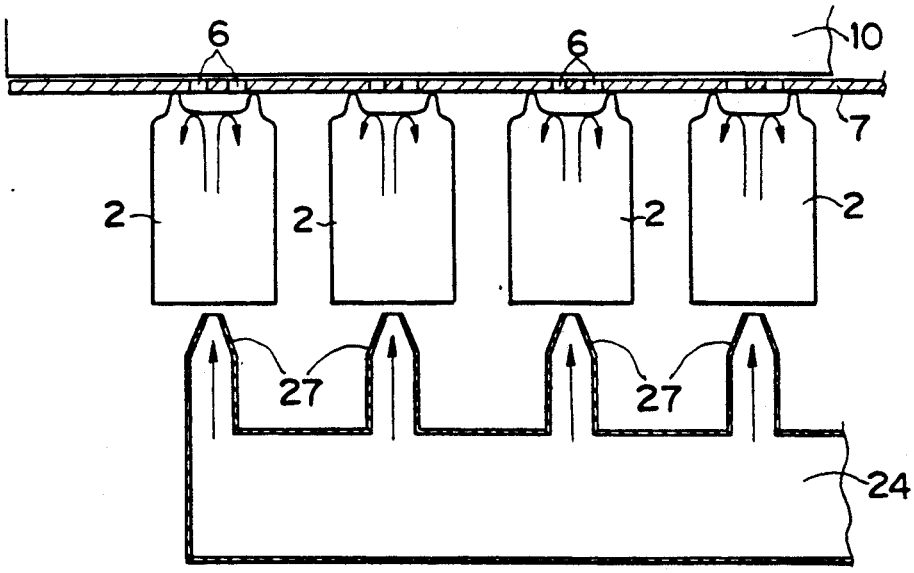
FIG. 7 is a sectional view showing the internal drying nozzle arrangement depicted in FIG. 6.

The above described embodiment is such that it requires the provision of the blow nozzles 17. In the event that these nozzles are omitted the hot air nozzles 23 can, in accordance with a second embodiment of the invention, be replaced with hot air nozzles 27 of the nature illustrated in FIGS. 6 and 7. As shown in the just mentioned figures, the hot air nozzles 27 are of the elongate narrow slit type which are arranged parallel to the direction in which the belt 7 moves and to extend along below the suspended containers 2 so that hot air can flow directly into the interiors of the same. This tends to speed up the water removal process and to reduce the time required for drying the containers.

It should be noted that in this case, the hot air blown directly into the interior of the containers 2, is clean and does not lead to any contamination of the interior as the air is filtered by filter 19 before ejection.

Figure 8:
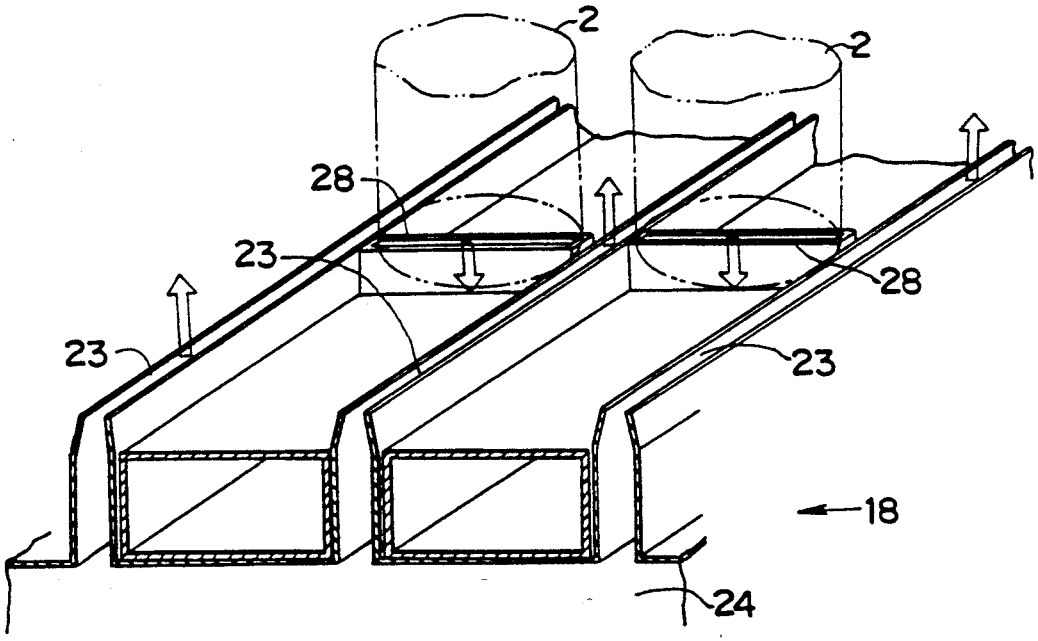
FIG. 8 is a perspective view showing a combination of suction and hot air nozzles in accordance with a third embodiment of the present invention.

As will be appreciated from the above, if a relatively large amount of residual water is firstly removed in liquid form, it is possible to reduce the amount heat which is required to complete the drying process. With this concept in mind a third embodiment of the invention features the provision of suction nozzles in combination with those which eject hot air. As shown in FIG. 8, suction nozzles 28 of the elongate narrow slit type are arranged to extend laterally between hot air nozzles 23.

The length of the suction nozzles 28 is selected to be slightly greater than the diameter of the containers 2 and the nozzles 28 are arranged to project up to a level which closely juxtaposes the edges of the open ends of the containers 2. The hot air nozzles are arranged to direct air vertically upward.

It should be noted that while the above disclosed embodiments are directed to be used with two piece can body type containers, the present invention is not limited to the same and can be used with any similar type of container that has an open end and that can be suspended in a inverted manner.

The drying method according to the present invention is such that as water removal is carried out prior hot air drying, it is possible to utilize drying air having relatively low temperatures which range from 80°-150° C. Further, it is within the scope of the present invention to use magnetic force in place of and/or in combination with the above described pressure differential to lift and secure the containers to the lower surface of the conveyor belt if desired.

In summary, the present invention is such that the containers are supported in an inverted state and transported through the drying device in manner wherein the open ends of the containers do not come into contact with any apparatus which might cause the interior of the containers to become contaminated. This obviates any hindrance to painting or the like.

Particularly if the containers are dried by exposure of their exterior to air flows, the interior of the containers, can be easily prevented from becoming contaminated. On the other hand, if air flow is directed into the interior of the containers, drying time can be reduced. In this latter case, if the air is filtered before being directed against the containers, contamination can be effectively prevented.

If water is removed from the containers in liquid form such as by the use of suction nozzles, the amount of water which must be removed via subsequent air ejection techniques is reduced and the time required to bring the containers to a near completely dried condition is shortened. It is also possible to reduce the amount of heat energy which must be used to achieve the desired drying degree. Additionally, the drying apparatus can be rendered compact and permit the length of the production line of which it forms a part to be reduced in length.

A further feature of the invention comes in that, if air injection is used to drive residual water down toward the open end of the inverted containers, the effect of suction nozzles for removing water in liquid form can be improved thus leaving even less water to be removed via evaporation. This markedly speeds up the drying process, reduces the amount of energy required to achieve the same, and further allows the drying apparatus to be reduced in size.

What is claimed is:

1. A drying apparatus for drying containers each having a bottom wall, a side wall and an open end, which have been washed, comprising:

transport means to which the bottom wall surfaces of the containers can be induced to adhere, for suspending the containers with the open ends thereof oriented downwardly and for transporting the containers though the entire drying apparatus;

at least one suction nozzle disposed below said transport means and arranged to closely proximate the open ends of the containers as they are transported therepast by said transport means; and at least one air ejection nozzle disposed below said transport means and downstream of said suction nozzles with respect to the direction in which the containers are transported, said air ejection nozzles comprising means for directing a flow of air upwardly toward the suspended containers as they are transported therepast.

2. A drying apparatus as set forth in claim 1 wherein said transport means includes a belt, said belt having a first surface to which the bottom wall surfaces of the containers are induced to adhere.

3. A drying apparatus as set forth in claim 2 comprising:

a plurality of suction holes formed through said belt; and suction head means disposed in close proximity to a second surface of the belt for inducing air through said plurality of suction holes.

4. A drying apparatus as set forth in claim 3 wherein said suction holes are arranged in rows which are parallel to the direction in which the belt moves, the rows being spaced from one another by a distance which is greater than a diameter of the containers.

5. A drying apparatus as set forth in claim 3 wherein said holes are elongate in shape.

6. A drying apparatus as set forth in claim 1 wherein said transport means uses magnetic force to induce the containers to adhere thereto.

7. A drying apparatus as set forth in claim 3 wherein said suction head means comprises a first suction head disposed above a location wherein said suction nozzles are disposed, and a second suction head which is disposed above a location wherein said air ejection nozzles are disposed, said first suction head being fluidly communicated with an exhaust blower and said second suction head being fluidly communicated with a circulation blower.

8. A drying apparatus as set forth in claim 7 further comprising:

a duct which leads from said second suction head to an induction port of said circulation blower, an air heater disposed in said duct; and an air filter disposed in said duct;

wherein a discharge port of said blower is fluidly communicated with said air ejection nozzles.

9. A drying apparatus as set forth in claim 1 wherein said air ejection nozzles are slit type nozzles which are arranged parallel to the direction in which the containers are transported by said transport means, and are positioned to eject air upwardly at a location between the containers so that the air which is ejected therefrom flows up between containers and over the external surfaces thereof.

10. A drying apparatus as set forth in claim 9 further comprising additional slit type suction nozzles for removing liquid water from the containers, said additional suction nozzles being arranged to closely proximate the open ends of the containers as they are transported therepast by said transport means.

11. A drying apparatus as set forth in claim 1 wherein said air ejection nozzles are slit type nozzles which are arranged parallel to the direction in which the containers are transported by said transport means, and are positioned to eject air upwardly at a location of the open ends of the containers so that the air which is ejected therefrom flows up into the interior of the containers as they are transported thereover.

12. A drying apparatus a set forth in claim 1 wherein said suction nozzles are slit type nozzles which extend laterally with respect to the direction in which the containers are transported by said transport means.

13. A drying apparatus as set forth in claim 9 further comprising at least one air injection nozzle at a predetermined location upstream of said suction nozzles with respect to the direction in which the containers are transported by said transport means, said air injection nozzles comprising means for injecting air into the interior of the containers as they are transported thereover.

14. A drying apparatus as set forth in claim 13 wherein said air injection nozzles have an essentially circular cross-section.

15. A drying apparatus for drying containers each having a bottom wall, a side wall and an open end, and which have been washed, comprising:

a moving conveyor belt in which through holes are formed;

a first suction head which closely proximates an upper side of said conveyor belt, said first suction head being fluidly connected with an exhaust blower, said first suction head inducting air through said through holes in a manner which produces a suction effect and enables containers which each have an open end to be attracted to and held against a second side of said conveyor belt, in a manner wherein the open ends of the containers are oriented downwardly;

at least one suction nozzle disposed below said first suction head and on a lower side of said conveyor belt, said suction nozzles being arranged to closely proximate the downwardly oriented open ends of the containers suspended on said conveyor belt;

a second suction head disposed in close proximity to said conveyor belt, and adjacent said first suction head, said second suction head inducing air through said through holes in a manner which maintains the suction effect which holds the containers against the second side of said conveyor belt;

a circulation blower which has an induction port fluidly communicated with said second suction head by way of a duct;

a heater disposed in said duct for heating the air which is inducted by said circulation blower; and at least one air ejection nozzle disposed below said second suction head and on an opposite side thereof with respect to said conveyor belt, said air ejection nozzles being fluidly communicated with a discharge port of said circulation blower for receiving heated air therefrom, and for directing heated air upwardly toward the containers which are held against the second side of said conveyor belt.

16. A method of drying containers each having a bottom wall, a side wall and an open end, which have been washed comprising the steps of:

applying an attractive force to an external surface of each of the containers so that the containers are held suspended against a transport device in a manner wherein the open ends of the suspended containers are each oriented downwardly;

using at least one suction nozzle which extends to a level which closely proximates the open ends of the suspended containers as they are transported therepast, to remove water in liquid form from the suspended containers; and ejecting drying air upwardly toward the suspended containers.

17. A method as set forth in claim 16 wherein said step of ejecting drying air comprises directing the air flow against the external surfaces of the containers.

18. A method as set forth in claim 16 wherein said step of ejecting drying air comprises directing the air flow against the internal surfaces of the containers.

19. A method as set forth in claim 18 wherein the step of directing air against the internal surfaces of the containers is carried out before the step of removing water in liquid form using said suction nozzles is performed.

* * * * *

UNITED STATES PATENT AND TRADEMARK OFFICE

CERTIFICATE OF CORRECTION

PATENT NO. : 5,271,164

DATED : December 21, 1993

INVENTOR(S) : Takayuki YOSHIMURA et al

It is certified that error appears in the above-indentified patent and that said Letters Patent is hereby corrected as shown below:

Column 9, line 3, change "a set forth" to --as set forth--.

Signed and Sealed this

Second Day of August, 1994

*Attest:*

Bruce Lehman

BRUCE LEHMAN

*Attesting Officer*

*Commissioner of Patents and Trademarks*